US010352136B2

(12) United States Patent
Goyeneche

(10) Patent No.: US 10,352,136 B2
(45) Date of Patent: Jul. 16, 2019

(54) APPARATUS FOR ELECTROMECHANICALLY CONNECTING A PLURALITY OF GUNS FOR WELL PERFORATION

(71) Applicant: Sergio F Goyeneche, Spring, TX (US)

(72) Inventor: Sergio F Goyeneche, Spring, TX (US)

( * ) Notice: Subject to any disclaimer, the term of this patent is extended or adjusted under 35 U.S.C. 154(b) by 0 days.

(21) Appl. No.: 15/312,120

(22) PCT Filed: May 15, 2015

(86) PCT No.: PCT/US2015/031047

§ 371 (c)(1),
(2) Date: Nov. 17, 2016

(87) PCT Pub. No.: WO2016/186611

PCT Pub. Date: Nov. 24, 2016

(65) Prior Publication Data

US 2018/0119529 A1 May 3, 2018

(51) Int. Cl.

| | |
|---|---|
| ***E21B 43/117*** | (2006.01) |
| ***E21B 43/118*** | (2006.01) |
| ***E21B 43/119*** | (2006.01) |
| *E21B 43/263* | (2006.01) |
| *F42B 1/036* | (2006.01) |

(52) U.S. Cl.

CPC ..... *E21B 43/117* (2013.01); *E21B 43/118* (2013.01); *E21B 43/119* (2013.01); *E21B 43/263* (2013.01); *F42B 1/036* (2013.01)

(58) Field of Classification Search

CPC .... E21B 43/117; E21B 43/118; E21B 43/119; E21B 43/263; E21B 43/11; E21B 43/114; E21B 43/116; F42B 1/036

USPC ..... 89/1.151, 1.15; 175/4.55, 4.56, 4.57, 175/4.58, 4.59; 102/320, 314, 315, 319, 102/321

See application file for complete search history.

(56) References Cited

U.S. PATENT DOCUMENTS

| | | | | |
|---|---|---|---|---|
| 2003/0047358 | A1* | 3/2003 | Bonkowski | E21B 43/116 175/4.6 |
| 2004/0216866 | A1* | 11/2004 | Barlow | E21B 17/042 166/55 |
| 2013/0118342 | A1* | 5/2013 | Tassaroli | E21B 43/116 89/1.15 |
| 2015/0337635 | A1* | 11/2015 | Langford | E21B 43/116 89/1.15 |
| 2017/0211363 | A1* | 7/2017 | Bradley | F42B 3/08 |

* cited by examiner

*Primary Examiner* — John Cooper
(74) *Attorney, Agent, or Firm* — The Law Offices of Kevin M. Jones & Associates, LLC

(57) ABSTRACT

A gun assembly for perforating wells comprising a plurality of guns with shape charges aligned centrically by end caps having insulated connector pins for conducting electrical signals and pressure through the end caps while preventing debris from the blast of one gun from entering and damaging the electrical connections and components of the next gun. The end caps being interconnected physically and electrically by specialized intermediate subs.

17 Claims, 7 Drawing Sheets

APPARATUS FOR ELECTROMECHANICALLY CONNECTING A PLURALITY OF GUNS FOR WELL PERFORATION

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

Field of the Invention

This invention refers in general to an integral assembly (a "perf assembly") of a plurality of perforating guns ("guns") containing a plurality of shape charges ("charges"). This perf assembly is used in perforation of wells. This invention is particularly directed to a new electro-mechanical assembly for connecting a series of guns to allow reliable assembly and reliable sequential firing of the guns during the perforation process of production wells. This process of well perforation consists of the perforation of the metallic casing of a well, of isolating the cement surrounding the casing, and of the layers of rock in the producing formation by means of explosives housed within perforating guns; achieving, through bore holes produced by a plurality of charges, a connection between the depths of the producing zone and the interior of the well. While this invention is generally found in the petroleum production industry, it may be equally applied to other environments where perforation of well casing into the surrounding environment is necessary, such as water wells.

Background of the Invention

The perforation of producing wells is realized by lowering into the well a perf assembly comprised of a plurality of guns each containing a plurality of charges. A firing wire, coupled with the casing as a ground, carries an electrical signal through the well bore to connect with each gun and allow firing of the detonators. The detonators may be fired through independently addressable switches or through a series of pressure switches and diodes which isolate each gun until the desired firing event.

One method of independently firing the guns is to use individually addressable detonators such as those described in U.S. Pat. Nos. 8,091,477 and 8,230,788. Another method of independently firing the guns is to connect each gun through a pressure sensitive switch which grounds the detonator of each gun until the pressure of the previous gun's firing triggers the switch to an active state. Further, diodes are used to cause each gun to require a polarity reversal from the signal which fired the previous gun. This prevents the signal from propagating throughout the assembly as the blasts set each pressure switch.

This method requires a continuous electrical signal to run the length of the perf assembly. However, wires are often twisted, broken, or can pull loose during the assembly process during the act of screwing the subs together. This results in the assembly having to be deconstructed and repaired. Additionally, weakened wires may pass initial test during construction only to fail during the process of lowering the assembly to depth, or due to vibrations of early charges in the sequence.

The preferred method is to fire the farthest/lowest gun first. Then, sequentially fire each gun back toward the well opening. This is because the explosion/pressure/debris from one gun's firing can possibly damage neighboring guns. Wires can break or connectors can loosen during shockwave vibrations, or by blast force. With pressure switches, any damage requires retrieval of the perf assembly for correction, as the rest of the assembly is now non-fireable. Addressable switches allow a damaged section to be skipped, but still result in unfired guns. Unfired guns are highly undesirable, as they are hazardous to bring to the surface due to the dangers of handling explosives which are not known to be in a safe condition or state.

To fulfill the operation so briefly described above, while simultaneously respecting existing norms for the manipulation of explosives, highly capable operators are required to arm and assemble the guns and the wellhead, stripping the ends of connecting wires and joining them by twisting the exposed portions of the wire together and covering the joint with adhesive electrical tape, resulting in an 'artisanal' activity requiring extreme caution.

It should be noted that petroleum production and exploration activities are generally located in areas with hostile climatic conditions for the operators; work hours are assigned in accordance to the needs of the operation and may include nighttime and daytime hours, with extreme cold or heat, rain or wind, darkness or sunlight. Hours are controlled by working against the clock and by penalizing setbacks; to that respect, it is absolutely necessary that the strictest safety norms be followed while handling explosive material; all of these factors together contribute to an increased likelihood that operators may commit errors while wiring or assembling the guns into a perf assembly to be introduced into the well. Further, even if the operators do everything correctly, the actions required to connect the pipe sections that make up the perf assembly may still produce a costly mistake.

From the above facts, there exists an obvious need to simplify the operation of arming and joining the guns into a perf assembly. There is also a need to ensure that the firing of one gun does not introduce faults into the remaining portions of the perf assembly preventing the required firing sequence. The object of this invention deals with the means to perform the electromechanical connection of the gun assembly.

SUMMARY OF THE INVENTION

Facing the current state of the techniques on the subject, an improved assembly for use in petroleum producing wells is proposed where a rigid end plate design aligns insulated contact pins, which couple with pressure switches to carry the pressure from one charge through the end plates to set the pressure switch of the next gun, while protecting the next gun from damaging debris of the explosion.

Currently in the industry a plastic insulating bottom end cap attaches to the charge carrier, and approximately centers it within the body. The bottom end cap has a central hole through which passes a wire carrying the electrical firing signal. A second wire connects to a grounding pin affixed to the plastic end cap which is routed to brush against the gun body to establish a ground.

The distal end of the charge carrier has a different plastic insulating end cap, called a top cap, which attaches to the charge carrier, and approximately centers it within the gun body. The top end cap has a screw with a wire lug attached to the distal end of the signal wire passing from the bottom end cap. The screw passes through the top end cap to contact the pressure switch for the next gun. The wire lug is a common breaking point if the wire does not absorb the twisting of the assembly process.

The innovation includes replacing the traditional plastic end caps on each charge carrier with an improved design which is more robust and reliable in the assembly of multiple guns into a single perf assembly. The improved gun end cap comprises the majority of the improvements which form the basis of this invention.

The improved gun end caps, in the preferred embodiment, are machined from aluminum and comprise a through hole in the center. A guiding pin extends laterally and runs from outer face to the inner face of the end cap, being beveled on the inner edge to facilitate assembly. The guiding pin engages a slot in the gun body to align the charges. The inner face has an edge extending from the inner face and, a charge carrier mating surface which engages the inner diameter of the charge carrier and is secured thereto.

At least one secondary guide point extends from the end cap to force the guiding pin into the slot; to ensure grounding contact between the end cap and the gun body; center the end cap within the gun body; and reduce friction between the end cap/gun body interface during assembly by reducing the contact surfaces. In one embodiment, a single guiding point is position counter to the guide pin and is substantially wider than the guide pin to prevent it from mistakenly being assembled into the slot.

In the preferred embodiment, two secondary guiding points extend from the end cap edges approximately one hundred and twenty degrees (120°) apart from the principle guide pin. In addition to ensuring contact with the gun body for grounding of the electrical signal, the guide pin and guide points ensure centering of the contact pin within the gun body so that proper alignment with the subs is achieved.

The through hole in the center of the bottom end cap may remain open for wires to pass through for connection to the detonator as with the plastic end cap system, however there is no need for the grounding pin, as the wire may be attached directly to the face of the end cap via a screw. Since the aluminum is conductive, it grounds to the gun body. The signal wire passes through the gun body to attach to a contact pin.

The through hole in the center of the top end cap has a contact pin biased outward via a spring, and retained by a locking nut. In the preferred embodiment, the pin is aluminum and is coated in an insulating plastic to isolate it electrically from the end cap, allowing it to conduct the electrical signal from the wire to the plunger of the pressure switch which contacts the pin's recessed external end. The spring biases the pin to project outward from the outer side, and allows it to compress inward during the assembly process as the subs are joined, and to account for minor variances in length of the components during manufacturing. The outward force of the spring ensures the pin remains in electrical contact with the next gun's pressure switch, but without exerting enough force to engage said pressure switch.

The pin is secured by a locking nut on the inner side of the end cap, which sits in a hex shaped recess on the inner surface of the end cap. This hex shaped recess eliminates the need for tooling when the device is assembled. Further, the matching nut and end cap recess ensures blast pressure does not escape around the pin, but instead it acts on the pin to shift it outwardly to engage the pressure switch of the next gun. One skilled in the art would appreciate that other shapes would accomplish the same task as the hex nut and recess employed herein.

Where addressable switches are employed, a pressure switch may be replaced with a conducting axial rod with insulating sheath, as found in a traditional firing head or top sub. This axial rod is housed in a Tandem Sub and extends the signal from one gun to the next by mating with the pins in each end cap. The pins in the end cap mate via contact which allows the pins of the axial rod to sit in the recessed ends of the pins, and is secured by pressure from the spring.

DETAILED DESCRIPTION OF THE PREFERRED EMBODIMENTS

The following is a detailed description of exemplary embodiments to illustrate the principles of the invention. The embodiments are provided to illustrate aspects of the innovation, but the invention is not limited to any embodiment. As those skilled in the art will appreciate, the scope of the invention encompasses numerous alternatives, modifications, and equivalent; it is limited only by the appended claims.

Figure 1:
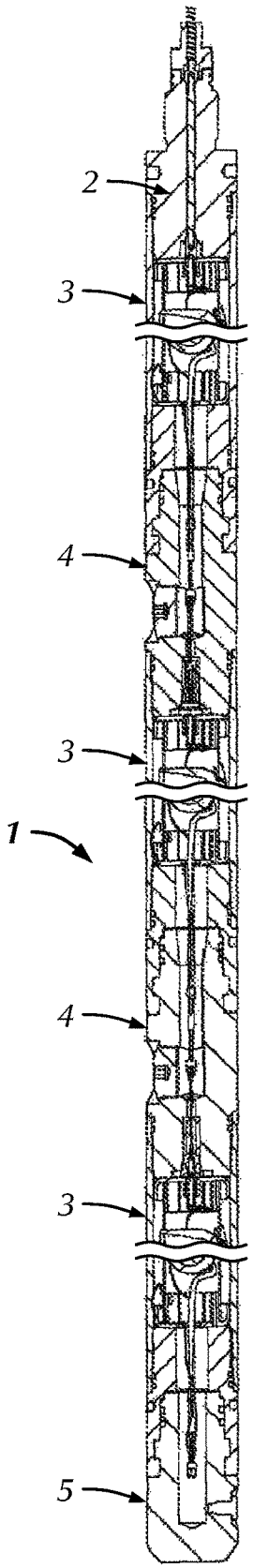
FIG. 1 (Prior Art)
FIG. 1 is a cross-section of an assembly of three armed and assembled guns in a manner that is in accordance with this invention.

In relation to FIG. 1, the perf assembly (1) has a firing head (2), three perforating guns (3), each containing a charge carrier, two tandem subs (aka subs) (4), and a bottom sub (5). The mentioned parts are tubular pieces provided at the ends of the elements of the machined joint that will be described briefly, as they are not included within the sphere of protection of this innovation.

One skilled in the art would be aware with the composition of drill strings which comprises one or more of the following: drill pipe, subs, drill collars, stabilizers, shock absorbers, tools, reamers, bits, and other in-hole equipment. One skilled in the art would be aware the overwhelming majority of these items utilize Rotary Shouldered Threaded Connections which are commonly referred to as "pin and box" connections. One skilled in the art would appreciate that the male (externally threaded) version is commonly referred to as a "pin" or "pin fitting", and the female (internally threaded) version is commonly referred to as a "box" or "box fitting", and they are generally manufactured to specifications developed and approved by the American Petroleum Institute, which includes internal and external diameters, wall thicknesses, upset dimensions, nominal size, weight, and grade as well as tool joint type, to ensure joint mating of similar products manufactured by different companies. All references to drill pipe, subs, collars, bits, etc. are referred to in conformity with API usage unless otherwise specifically designated herein.

Figure 2:
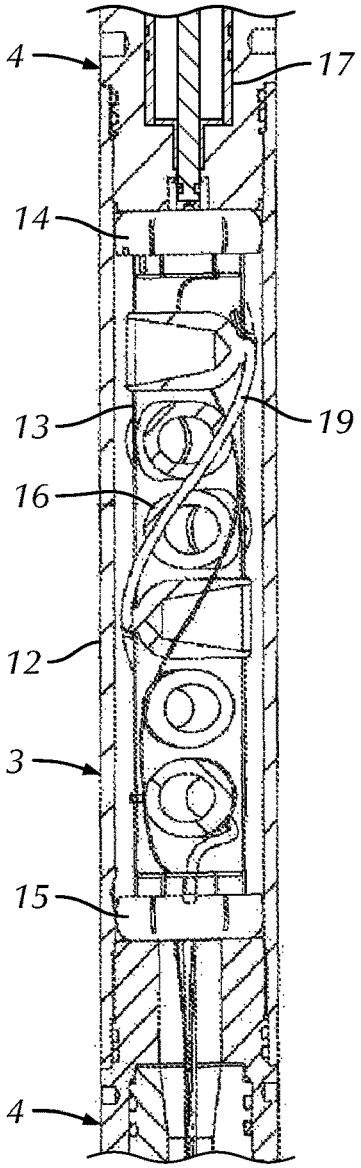
FIG. 2 (Prior Art)
FIG. 2 shows a cross section of a single gun joined on each end with a tandem sub.

FIG. 2, shows a gun (3) which comprises a charge carrier (13) with a plurality of explosive shape charges (16) joined by a detonation cord or fuse (19). The charge carrier (13) is supported, substantially centered, within the gun body casing (12) by an insulating top end (14) and an isolating bottom end (15). More detail of the centralizing end plates will be provided below.

One can see in the interior of the carrier (13) that the shaped charges (16) are shown set in radial fashion, that is to say, perpendicular to the gun wall, to the carrier, and, when the guns are within the well, to the well casing. In the illustration, six shape charges are illustrated, but the actual number and orientation vary.

The shaped charges are explosives set in such a manner that they concentrate the force of the explosion outward, generating a jet of gas (plasma) at high pressure and temperature, that pulls the metal from the interior of the charge and projects it outward until it arrives at the well formation; with this action the charges produce a perforating effect that is variable in proportion to the potency of the charges.

In each intermediate joint or intermediate sub or tandem sub (4) one can see the pressure activated changeover switch (17), from which wires extend to the rest of the assembly. When the detonator is activated, a detonation is propagated by way of a "fuse"—or detonating cord (19)—to each of the shaped charges in the carrier (13) that burst in simultaneous fashion within the corresponding gun (3). Although not described in detail herein, the internal details of the assembly are protected by a watertight seal, otherwise the liquids present in the well would enter into the interior of the gun causing problems with the electric and/or ballistic systems.

Figure 2A:
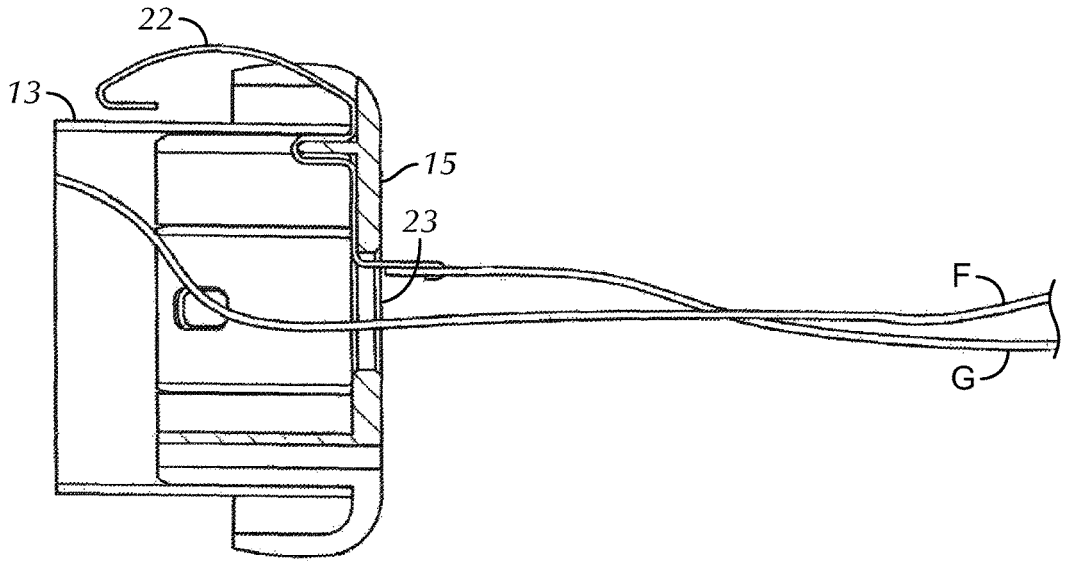
FIG. 2A (Prior Art)
FIG. 2A shows an insulator cap assembly prior to mating with the gun or sub.

In FIG. 2A, the insulating end plate is represented as being attached to the lower end of the charge carrier (13), and has a tab for connecting the ground wire (22) from the carrier to the interior of the gun housing; furthermore, it has a hole, or central orifice, (2) that permits the passage of a pair of wires, 'live' or 'fire' (F) and 'ground' (G). These wires are connected to the components in the next tandem immediately below to pass the signal throughout the assembly (1, not illustrated) as required by the electronic configuration thereof. One skilled in the art will appreciate that these wires can be connected by stripping/twisting/taping; by electrical nuts; or by specialized contact connectors. It is important that the wires be connected correctly and securely to ensure they do not become loose during the handling, break during the assembly process, or short against the housing.

Figure 2B:
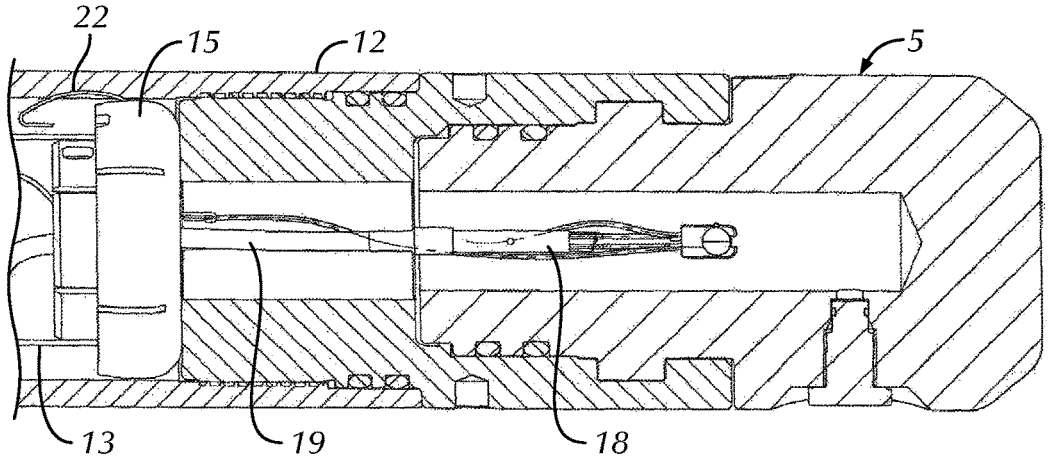
FIG. 2B (Prior Art)
FIG. 2B shows a bottom sub assembly containing a detonator attached to a bottom sub and mated with a gun.

In FIG. 2B, the insulating end plate (15) centers the charge carrier (13) and causes the grounding contact (22) to connect with the gun body (12) represented as being attached to the lower end of the charge carrier (13), and has a tab for connecting the ground wire (22) from the carrier to the interior of the gun housing; furthermore, it has a hole, or central orifice, (23) that permits the passage of a pair of wires, 'live' or 'fire' (F) and 'ground' (G). These wires are connected to the components in the next tandem immediately below to pass the signal throughout the assembly (1, not illustrated) as required by the electronic configuration thereof. One skilled in the art will appreciate that these wires can be connected by stripping/twisting/taping; by electrical nuts; or by specialized contact connectors. It is important that the wires be connected correctly and securely to ensure they do not become lose during the handling, break during the assembly process, or short against the housing.

Figure 3A:
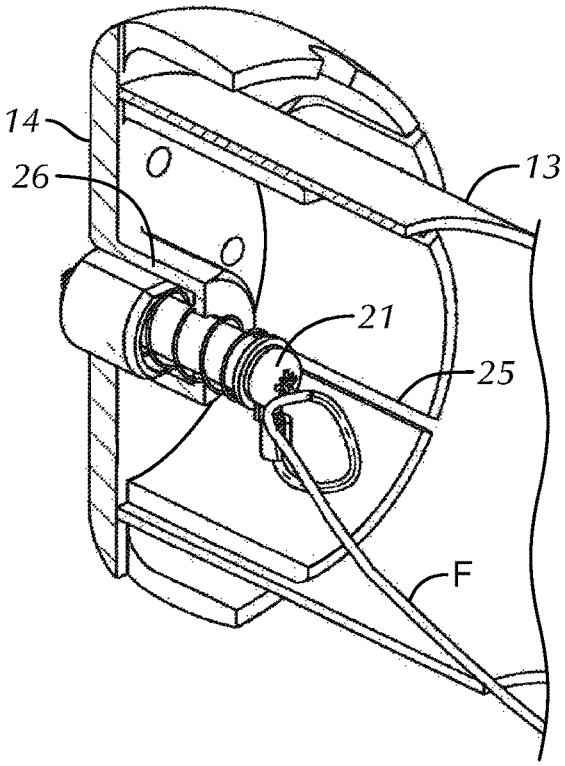
FIG. 3A (Prior Art)
FIG. 3A shows the wired retractable contact pin installed into an insulating top end assembly prior to mating with a sub.

In FIG. 3A the end plate (14) with the retractable contact pin (21) is shown attached on the upper end of the charge carrier (13). From the top of the end plate (14) protrudes a moving contact point that will make contact with the bottom side of a pressure switch (17, not shown) for the next component in the perf assembly (1, not shown), to allow the passage of the "live" wire towards the bottom. The tension from the spring urges the contact pin outward from the charge carrier (13) to adapt to any movement of parts and/or differences in length.

The end plate (14) is a tubular piece of plastic with peripheral skirt, bearing a groove (25) that allows it to adapt and center the carrier (13) within the tolerances set by the perforating gun tube provider. The end plate (14) possesses a central tubular portion (26) for mounting the retractable contact pin (21), which contains a screw that connects the fire line (F) to the next device.

Figure 3B:
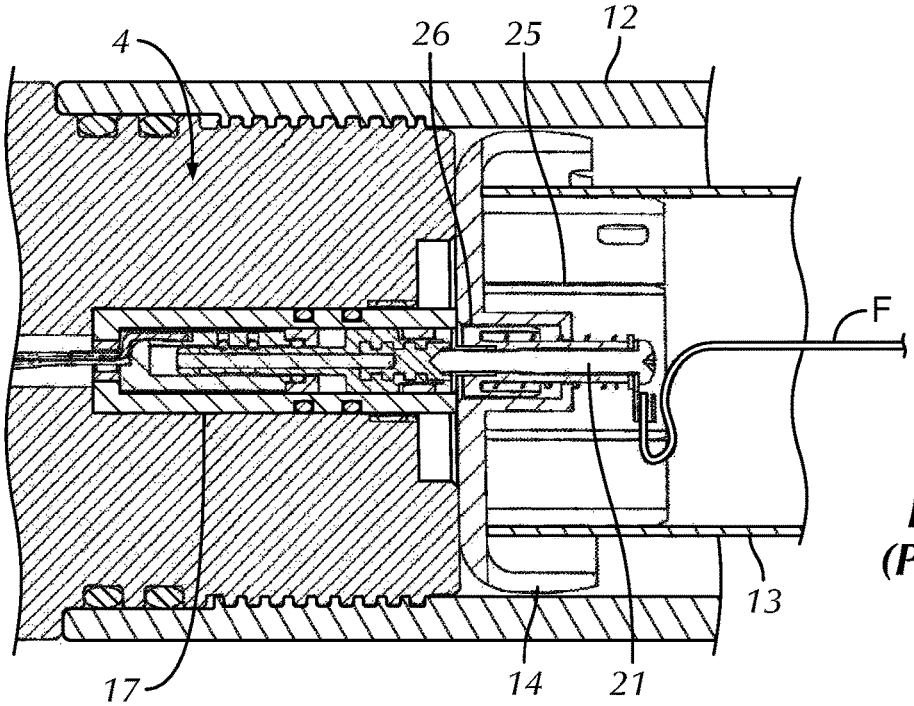
FIG. 3B (Prior Art)
FIG. 3B, is another detailed view of a tandem sub, showing the end cap of the gun and pressure switch of the tandem sub in their respective positions in the gun assembly.
Figure 4A:
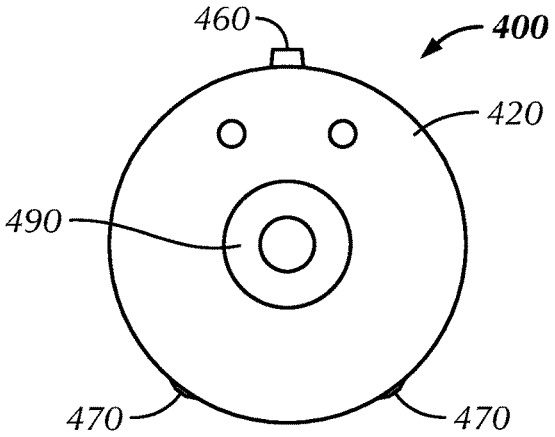
FIGS. 4A, 4B, and 4C are views of an end cap in accordance with an exemplary embodiment of the innovation.
Figure 4B:
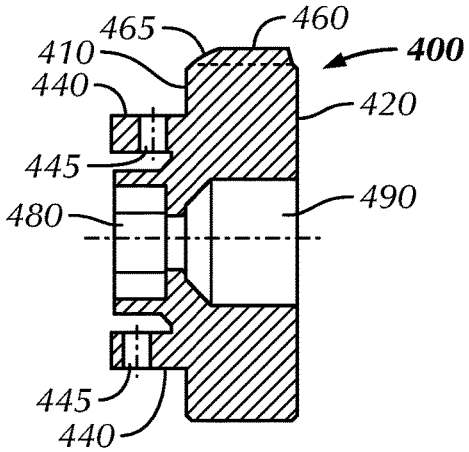
Figure 4C:
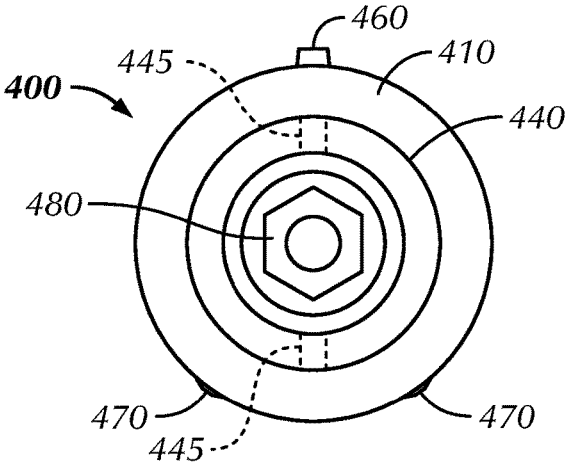
Figure 4D:
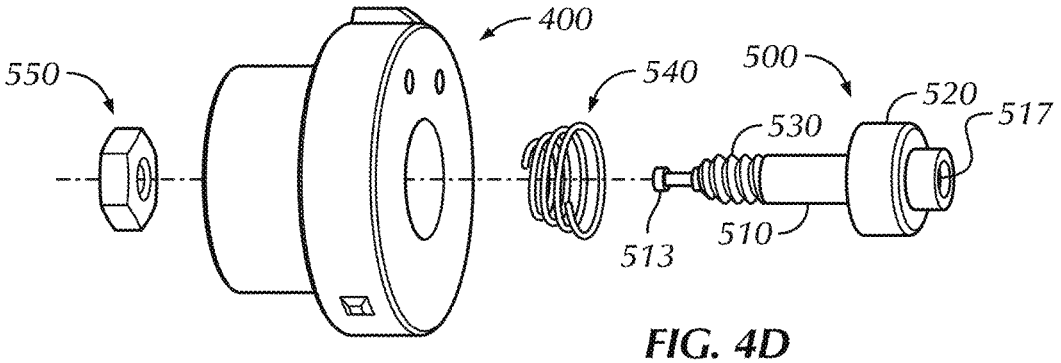
FIG. 4D is an exploded view of the end cap and contact pin assembly in accordance with an exemplary embodiment of the innovation.

In FIG. 3B the end plate (14) is shown in the assemble position. The end plate (14) with the retractable contact pin (21) is shown, and is represented on the upper end of the charge carrier (13). From the top of the end plate (14) protrudes a moving contact point (21) that will make contact with the piece above the carrier, shown herein as a pressure switch (17) set in a tandem sub (4). The retractable contact pin (21) is centered by the central tubular portion (26). Flexible grooves (25) anchor the end plate (14) in the charge carrier (13) and the peripheral skirt centralizes the assembly in the gun body casing (12). The signal fire wire (F) has slack to prevent breaking during the threading process of assembling the gun body casing (12) to the tandem sub (4).

FIGS. 4A, 4B, 4C, and 4D show a front, side cross section, back, and exploded view of an improved end cap in accordance with an exemplary embodiment of the innovation. The end cap (400) is manufactured from a durable solid material which is electrically conductive. In the preferred embodiment the end cap is manufactured from aluminum. The end cap (400) comprises an inner face (410) which is installed toward the charge carrier, and an outer face (420) which is directed toward the mating tandem sub during assembly. From the inner face (410) protrudes a circular projection, the charge carrier mating surface (440) which fits into the end of the charge carrier (13, not shown) and is secured by screws via the holes (445) in the charge carrier mating surface (440).

The end cap has a through hole for receiving the insulated contact pin (500). On the inner face (410) there is a void for receiving the nut which secures the contact pin. This void, hex shaped in the preferred embodiment (480), should match the shape of the nut so as to prevent blast pressure from escaping around it easily. The outer face (420) has a round void (490) for receiving a spring (540) and the pin (517). The spring (540) urges the contact pin (500) outward from the outer surface (420), but the pin (500) is retained by the nut (550) secured to the threads (530) at the inner surface (410).

The pin is coated in an insulating coating (520) which allows the fire signal wire (F) connected to the pin's (500) contact head (513) to pass the electrical signal through the pin body (510) to the pin base (517) where it contacts the next component in the assembly (100, not shown) without grounding against the end cap (400) which is in contact with the gun body casing (12, not shown).

In this embodiment, two secondary guide points (470) extend from the end cap edges approximately one hundred and twenty degrees (120°) apart from the principle guide pin (460). In addition to ensuring contact with the gun body for grounding of the electrical signal, the guide pin (460) and guide points (470) ensure centering of the contact pin (500) within the gun body so that proper alignment with the subs is achieved.

Figure 5A:
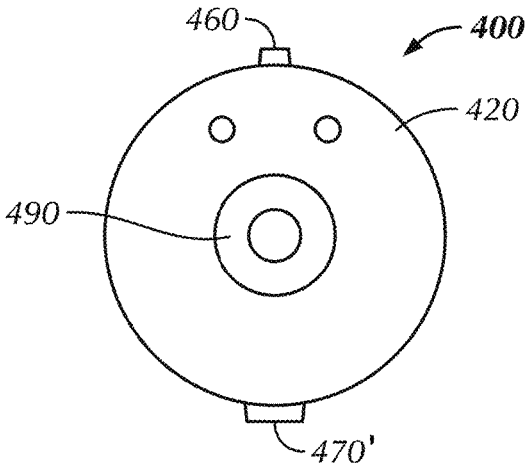
FIGS. 5A and 5B are views of an alternative embodiment of an end cap in accordance with an exemplary embodiment of the innovation.
Figure 5B:
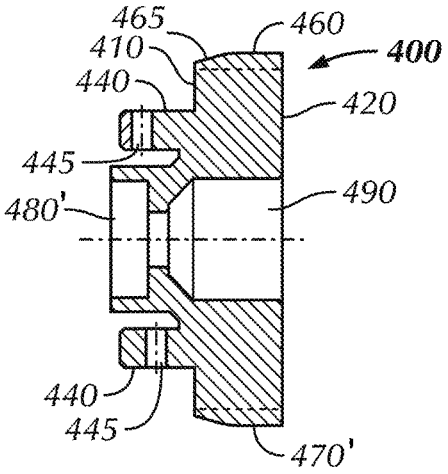

FIGS. 5A and 5B show an inner side and a side cross sectional view of an alternative embodiment of the end cap. The end cap (400) has a round opening (480') for the locking component of the contact pin. In this embodiment, a washer may be utilized with the nut. The spring opening (490), charger carrier mating surface (440) and screw holes (445) are the same as in the previous embodiment. The guide pin (460) remains the same situated on the edge of the end cap, extending from the inner surface (410) to the outer surface (420) with a bevel (465) on the inner surface side to ease insertion into the gun body casing (12, not shown).

A single secondary guide point (470') extends from the end cap edge to force the guide pin (460) into the slot: to ensure grounding contact, align the charges, and center the end cap within the gun body; and reduce the friction between the end cap/gun body during assembly by reducing the contact surfaces. In this embodiment, the single guide point (470') is positioned counter to the guide pin (460) and is substantially wider than the guide pin (460) to prevent it from mistakenly being assembled into the alignment slot of the gun body.

Figure 6:
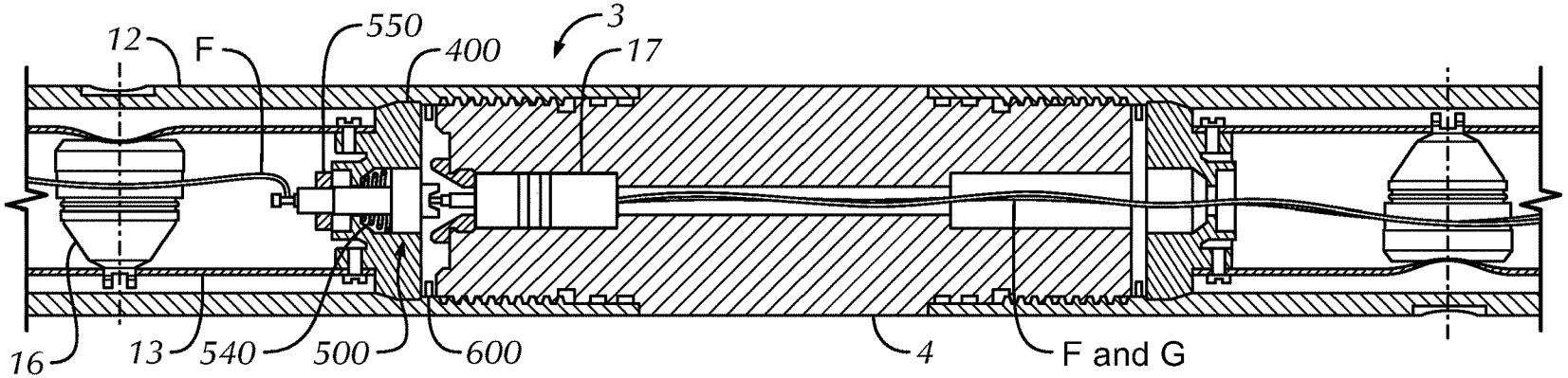
FIG. 6 is a cross section of an end cap assembly in gun body, and joined with a sub employing a pressure/diode switch in accordance with an exemplary embodiment of the innovation.

FIG. 6 shows a cross section of an intermediate sub incorporating a pressure switch with perforating guns mounted at either end. The perforating guns (3) mate to either end of the tandem sub (4) via screwing interface and pass the wiring signals (F & G) throughout the perf assembly (1, not indicated). The end cap (400) may be used at either end of the charge carrier (13). In the bottom end the center of the end cap (400) is left open so the firing wire (F) may pass from the pressure switch (17) to the detonator (18, not shown). In the top end the center of the end cap (400) contains the insulated contact pin (500) which is biased outward by the spring (540) and retained by the nut (550) to remain in contact with the pressure switch (17). The end cap (400) is held in position in the gun body casing (12) with a spring clip (600).

Figure 7:
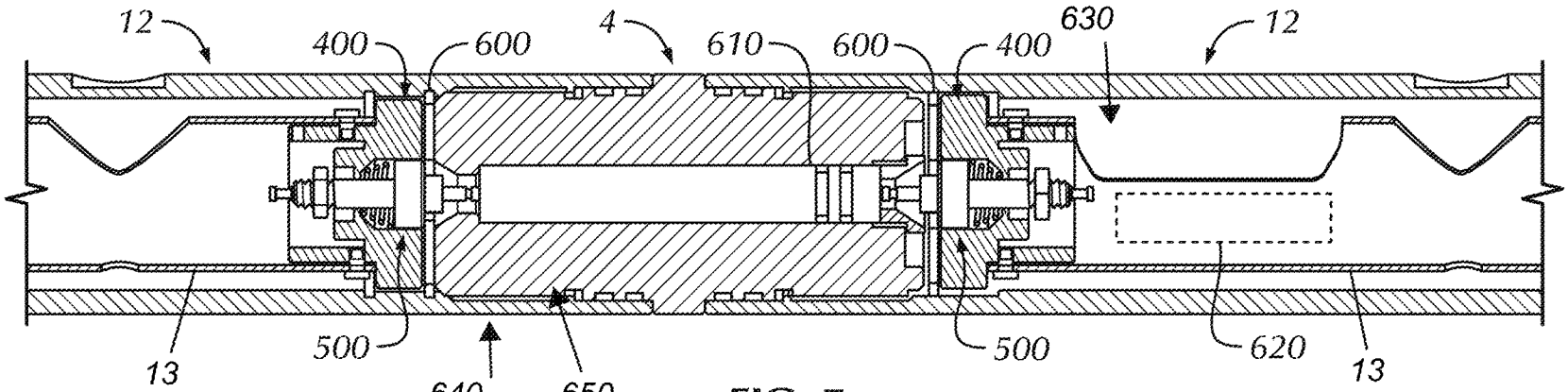
FIG. 7 is a cross section of an end cap assembled in a gun body employing addressable switches in accordance with an exemplary embodiment of the innovation.

FIG. 7 shows a cross section of an intermediate sub for use with addressable switches with perforating guns mounted at either end. The perforating guns (3, not indicated) mate to either end of the tandem sub (4) via screwing interface and pass the wiring signals (F & G) throughout the perf assembly (l, not indicated). The center of the end caps (400) contains the insulated contact pin (500) which is biased outward by the spring (540) and retained by the nut (550) to remain in contact with the feed through pin (610) which is also insulated to keep the fire signal isolated from the grounded body of the gun body casing (12) and tandem sub (4). The end cap (400) is held in position in the gun body casing (12) with a spring clip (600). This means the length of the charge carrier (13) and end caps (400) will be less than the length of the gun body casing (12) so the pin fittings (650) of the neighboring component, a tandem sub (4) in this embodiment, can properly mate with the box fittings (640) of the gun body casing (12). The firing signal is passed directly between guns (3, not indicated) through the tandem sub (4) to the addressable switch (620), since pressure switches are not required in this embodiment. The wiring for the addressable switch (620) or pressure switch and detonator (17 and 18, not shown) being located internal to the charge carrier and accessible by the wiring port window (630) for installation and wiring, usually done during on-site final assembly, without disassembling and possibly misaligning the charges or damaging the wiring in the charge carrier.

The diagrams in accordance with exemplary embodiments of the present invention are provided as examples and should not be construed to limit other embodiments within the scope of the invention. For instance, heights, widths, and thicknesses may not be to scale and should not be construed to limit the invention to the particular proportions illustrated. Additionally, some elements illustrated in the singularity may actually be implemented in a plurality. Some element illustrated in the plurality could actually vary in count. Some elements illustrated in one form could actually vary in detail. Such specific information is not provided to limit the invention.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A gun assembly for perforating wells comprising:

at least one gun body casing, the casing being a hollow cylinder, with a box fitting at each end;

a charge carrier, the carrier being a hollow cylinder, with exterior diameter less than the interior diameter of the casing, and a length shorter than the distance between the box fittings of the casing;

a plurality of shape charges positioned radially inside the charge carrier and inter connected by a detonator cord;

a plurality of end caps affixed to the ends of the carrier and axially aligning the carrier within the casing between the box fitting ends, and secured therein;

at least one end cap being of a durable material, electrically conductive and electrically connects the charge carrier of the gun body;

an addressable detonation switch electrically connected between an inner side of at least one end cap and the plurality of shape charges within the charge carrier.

2. The assembly of claim 1 wherein at least one end cap comprises a guide pin along the edge of the end cap;

the guide pin seating into a groove on the interior of the casing aligning the charge carrier within the gun casing.

3. The assembly of claim 1 wherein the end caps further comprise:

a metallic body;

the body further comprising:

an extended cylindrical ridge protruding from one face, the ridge fitting into the interior diameter of the charge carrier tube, and being secured thereto.

4. The assembly of claim 3 wherein securing the charge carrier tube to the end cap is by pining or screwing through the body of the tube into end cap.

5. The assembly of claim 3 wherein the end caps further comprise:

a charge pin passing through a centralized opening, the charge pin comprising:

a conductive core, a contact pin and a threaded shaft at one end, and a contact mating surface within an enlarged body on the distal end;

an electrically insulating coating;

the charge pin being biased to one side by a spring between the cap body and the charge pin's enlarged body, and retained within the centralized opening by a nut, threaded on the threaded shaft on the opposite side of the end cap.

6. The assembly of claim 5 wherein the charge pin nut loosely fits into a shaped void in the end cap to prevent blast pressure from passing through the end cap's centralized opening.

7. The assembly of claim 5 wherein the assembly further comprise: an intermediate sub mated to the gun assembly at a proximal end of the intermediate sub, wherein the intermediate sub comprises:

a pin fitting mating with the box fitting of the gun body casing;

a pressure switch, the pressure switch being centrally mounted at one end of the intermediate sub; and contacting the contact mating surface of the contact pin in the end cap of the gun.

8. The assembly of claim 7 wherein the intermediate sub further comprises:

a detonator.

9. The assembly of claim 8 wherein the assembly further comprises:

a second gun assembly mated to a distal end of the intermediate sub:

the second gun assembly having an end cap without a contact pin on the mating end, thereby leaving an open end cap;

wherein electrical cables of the pressure switch extend though the open end cap of the second gun assembly to electrically connect the gun assemblies together.

10. The assembly of claim 5 wherein the assembly further comprise:

an intermediate sub mated to the gun assembly, wherein the intermediate sub comprises:

a pin fitting mating with the box fitting of the gun body casing;

a feed through pin in the intermediate sub which is electrically insulated from the body of the intermediate sub, the feed through pin being centrally mounted and extending substantially the length of the intermediate sub; and contacting the contact mating surface of the contact pin in the end cap of the gun.

11. The assembly of claim 5 wherein the assembly further comprises: an intermediate sub mated to the gun assembly at a proximal end of the intermediate sub, wherein the intermediate sub comprises:

a pin fitting mating with the box fitting of the gun body casing;

an addressable detonation switch;

a feed through pin in the intermediate sub which is electrically insulated from the body of the intermediate sub, the feed through pin being centrally mounted and extending substantially the length of the intermediate sub; and contacting the contact mating surface of the contact pin in the end cap of the gun.

12. The assembly of claim 11 wherein the assembly further comprises:

second gun assembly mated to a distal end of the intermediate sub:

the second gun assembly also having an end cap with a contact pin;

the feed through pin in the intermediate sub contacting the contact mating surface of the contact pin in the end cap of the second gun assembly to electrically connect the gun assemblies together.

13. The assembly of claim 5 wherein the assembly further comprises: an intermediate sub mated to the gun assembly at a proximal end of the intermediate sub, wherein the intermediate sub comprises:

a pin fitting mating with the box fitting of the gun body casing;

a feed through pin in the intermediate sub which is electrically insulated from the body of the intermediate sub, the feed through pin being centrally mounted and extending substantially the length of the intermediate sub; and contacting the contact mating surface of the contact pin in the end cap of the gun.

14. The assembly of claim 13 wherein the assembly further comprises:

a second gun assembly mated to a distal end of the intermediate sub:

the second gun assembly also having an end cap with a contact pin;

the feed through pin in the intermediate sub contacting the contact mating surface of the contact pin in the end cap of the second gun assembly to electrically connect the gun assemblies together.

15. The assembly of claim 3 wherein the end caps further comprise:

a mounting point for an electrical ground connector.

16. The assembly of claim 15 wherein the mounting point on the end caps is a threaded hole for screwing a wire lug thereto.

17. The assembly of claim 15 wherein the mounting point on the end caps is a snap connector or connecting pin.

* * * * *